US010650738B2

(12) United States Patent
Park et al.

(10) Patent No.: US 10,650,738 B2
(45) Date of Patent: May 12, 2020

(54) PIXEL CIRCUIT AND ORGANIC LIGHT EMITTING DISPLAY DEVICE INCLUDING THE PIXEL CIRCUIT

(71) Applicant: Samsung Display Co., Ltd., Yongin-Si, Gyeonggi-Do (KR)

(72) Inventors: Junhyun Park, Suwon (KR); Cheol-Gon Lee, Suwon-si (KR); Yang-Hwa Choi, Hwaseong-si (KR)

(73) Assignee: Samsung Display Co., Ltd. (KR)

( * ) Notice: Subject to any disclaimer, the term of this patent is extended or adjusted under 35 U.S.C. 154(b) by 0 days.

(21) Appl. No.: 16/234,327

(22) Filed: Dec. 27, 2018

(65) Prior Publication Data

US 2019/0206316 A1 Jul. 4, 2019

(30) Foreign Application Priority Data

Jan. 4, 2018 (KR) ..... 10-2018-0001353

(51) Int. Cl.
*G09G 3/3225* (2016.01)
*G09G 3/3275* (2016.01)
*G09G 3/3266* (2016.01)

(52) U.S. Cl.
CPC ..... *G09G 3/3225* (2013.01); *G09G 3/3266* (2013.01); *G09G 3/3275* (2013.01); *G09G 2310/08* (2013.01)

(58) Field of Classification Search
None
See application file for complete search history.

(56) References Cited

U.S. PATENT DOCUMENTS

2011/0210958 A1 9/2011 Yoo et al.
2015/0062193 A1* 3/2015 Kanda ..... G09G 3/3233 345/690

FOREIGN PATENT DOCUMENTS

KR 10-2005-0122688 A 12/2005
KR 10-2014-0025781 A 3/2014
KR 10-2017-0081034 A 7/2017

* cited by examiner

*Primary Examiner* — Christopher J Kohlman
(74) *Attorney, Agent, or Firm* — Innovation Counsel LLP

(57) ABSTRACT

A pixel circuit includes three transistors, a capacitor, and an OLED. The first transistor includes a gate terminal for receiving a first control signal, a first terminal connected to a first node, and a second terminal connected to a second node. The second transistor includes a gate terminal for receiving a second control signal, a first terminal connected to the second node, and a second terminal connected to a third node. The third transistor includes a gate terminal connected to the first node, a first terminal for receiving a first power signal, and a second terminal connected to the third node. The capacitor may receive an initialization signal and is connected to the first node. The OLED is connected to the third node and may receive a second power signal. The control signals have same voltage levels in a data writing period and have different voltage levels in other periods.

20 Claims, 7 Drawing Sheets

PIXEL CIRCUIT AND ORGANIC LIGHT EMITTING DISPLAY DEVICE INCLUDING THE PIXEL CIRCUIT

CROSS-REFERENCE TO RELATED APPLICATION(S)

This application claims priority under 35 USC § 119 to Korean Patent Application No. 10-2018-0001353, filed on Jan. 4, 2018 in the Korean Intellectual Property Office (KIPO); the contents of the Korean Patent Application are incorporated herein in entirety by reference.

BACKGROUND

1. Technical Field

The technical field is related generally to a display device. More particularly, the technical field is related to a pixel circuit and an organic light emitting display device including the pixel circuit.

2. Description of the Related Art

A display device, such as an organic light emitting display device, may be included in an electronic device. An organic light emitting display device may implement (or, represent) a gray-scale using a data voltage stored in a storage capacitor included in each pixel circuit. Generally, in an organic light emitting display device, luminance deviations may occur among pixel circuits due to characteristic deviations of elements (e.g., transistors, capacitors) included in each pixel circuit. Alternatively or additionally, in an organic light emitting display device, an undesirable kickback phenomenon may occur in pixel circuits when an operating period of the pixel circuits is changed from a threshold voltage compensating period (during which a threshold voltage compensating operation is performed) to a data writing period (during which an data writing operation is performed). As a result, undesirable luminance non-uniformity may occur in an organic light emitting display device.

SUMMARY

Some embodiments are related to a pixel circuit that can prevent a kickback phenomenon from occurring when an operating period is changed from a threshold voltage compensating period to a data writing period. The pixel circuit may sequentially perform an on-bias operation, an initializing operation, a threshold voltage compensating operation, a data writing operation, and a light emitting operation.

Some embodiments may be related an organic light emitting display device that can display a high-quality image and may include the above-mentioned pixel circuit.

According to example embodiments, a pixel circuit may sequentially performs an on-bias operation, an initializing operation, a threshold voltage compensating operation, a data writing operation, and a light emitting operation. The pixel circuit may include the following elements: a first transistor including a gate terminal to which a first control signal may be applied, a first terminal connected to a first node, and a second terminal connected to a second node that is connected to a data-line through which a data signal may be transmitted; a second transistor including a gate terminal to which a second control signal may be applied, a first terminal connected to the second node, and a second terminal connected to a third node; a third transistor including a gate terminal connected to the first node, a first terminal to which a first power signal may be applied, and a second terminal connected to the third node; a storage capacitor including a first terminal to which an initialization signal may be applied and a second terminal connected to the first node; and an organic light emitting diode (OLED) including an anode connected to the third node and a cathode to which a second power signal may be applied. The first control signal may have a first high voltage level and a first low voltage level in a data writing period in which the data writing operation is performed. The first control signal may have a second high voltage level (lower than the first high voltage level) and a second low voltage level (higher than the first low voltage level) in one or more operating periods other than the data writing period. The second control signal may have the first high voltage level and the first low voltage level.

In example embodiments, the first control signal may be a global clock signal for a simultaneous emission driving.

In example embodiments, in the operating periods other than the data writing period, a rising edge time of the first control signal may be the same as a rising edge time of the second control signal, and a falling edge time of the first control signal may be the same as a falling edge time of the second control signal.

In example embodiments, in the operating periods other than the data writing period, a rising edge time of the first control signal may be longer than a rising edge time of the second control signal, and a falling edge time of the first control signal may be longer than a falling edge time of the second control signal.

In example embodiments, the first through third transistors may be p-type metal oxide semiconductor (PMOS) transistors.

In example embodiments, in an initializing period in which the initializing operation is performed, the first control signal may be changed from the second high voltage level to the second low voltage level after the second control signal is changed from the first high voltage level to the first low voltage level.

In example embodiments, in a threshold voltage compensating period in which the threshold voltage compensating operation is performed, the first control signal may be changed from the second low voltage level to the second high voltage level after the second control signal is changed from the first low voltage level to the first high voltage level.

In example embodiments, between the threshold voltage compensating period and the data writing period, the first control signal may be changed from the second high voltage level to the first high voltage level.

In example embodiments, in the data writing period, the first control signal may be changed from the first low voltage level to the first high voltage level when a data writing operation time elapses after the first control signal is changed from the first high voltage level to the first low voltage level.

In example embodiments, between the data writing period and a light emitting period in which the light emitting operation is performed, the first control signal may be changed from the first high voltage level to the second high voltage level.

According to example embodiments, a pixel circuit may sequentially performs an on-bias operation, an initializing operation, a threshold voltage compensating operation, a data writing operation, and a light emitting operation. The pixel circuit may include the following elements: a first transistor including a gate terminal to which a first control signal may be applied, a first terminal connected to a first node, and a second terminal connected to a second node that is connected to a data-line through which a data signal may be transmitted; a second transistor including a gate terminal to which a second control signal may be applied, a first terminal connected to the second node, and a second terminal connected to a third node; a third transistor including a gate terminal connected to the first node, a first terminal to which a first power signal may be applied, and a second terminal connected to the third node; a storage capacitor including a first terminal to which an initialization signal may be applied and a second terminal connected to the first node; and an organic light emitting diode including an anode connected to the third node and a cathode to which a second power signal may be applied. The first control signal may have a first rising edge time and a first falling edge time in a data writing period in which the data writing operation is performed. The first control signal may have a second rising edge time that is longer than the first rising edge time and a second falling edge time that is longer than the first falling edge time in one or more operating periods other than the data writing period. The second control signal may have the first rising edge time and the first falling edge time.

In example embodiments, the first control signal may be a global clock signal for a simultaneous emission driving.

In example embodiments, a high voltage level of the first control signal may be the same as a high voltage level of the second control signal, and a low voltage level of the first control signal may be the same as a low voltage level of the second control signal.

In example embodiments, the first through third transistors may be p-type metal oxide semiconductor (PMOS) transistors.

In example embodiments, in an initializing period in which the initializing operation is performed, the first control signal may be changed from the high voltage level to the low voltage level after the second control signal may be changed from the high voltage level to the low voltage level.

In example embodiments, in a threshold voltage compensating period in which the threshold voltage compensating operation is performed, the first control signal may be changed from the low voltage level to the high voltage level after the second control signal may be changed from the low voltage level to the high voltage level.

In example embodiments, in the data writing period, the first control signal may be changed from the low voltage level to the high voltage level when a data writing operation time elapses after the first control signal is changed from the high voltage level to the low voltage level.

According to example embodiments, an organic light emitting display device may include the following elements: a display panel including a plurality of pixel circuits that sequentially perform an on-bias operation, an initializing operation, a threshold voltage compensating operation, a data writing operation, and a light emitting operation; and a display panel driving circuit configured to provide a data signal, an initialization signal, a first control signal, a second control signal, a first power signal, and a second power signal to the pixel circuits. The first and second control signals may have the same voltage levels and the same edge times in a data writing period in which the data writing operation is performed. At least two voltage levels of the first control signal may be different from at least two voltage levels of the second control signal in one or more operating periods other than the data writing period. At least two edge times of the first control signal may be different from at least two edge times of the second control signal in the one or more operating periods other than the data writing period.

In example embodiments, each of the pixel circuits may include the following elements: a first transistor including a gate terminal to which the first control signal is applied, a first terminal connected to a first node, and a second terminal connected to a second node that is connected to a data-line through which the data signal may be transmitted; a second transistor including a gate terminal to which the second control signal may be applied, a first terminal connected to the second node, and a second terminal connected to a third node; a third transistor including a gate terminal connected to the first node, a first terminal to which the first power signal may be applied, and a second terminal connected to the third node; a storage capacitor including a first terminal to which the initialization signal may be applied and a second terminal connected to the first node; and an organic light emitting diode including an anode connected to the third node and a cathode to which the second power signal may be applied. The first control signal may have a first high voltage level and a first low voltage level in the data writing period. The first control signal may have a second high voltage level (lower than the first high voltage level) and a second low voltage level (higher than the first low voltage level) in the one or more operating periods other than the data writing period. The second control signal may have the first high voltage level and the first low voltage level.

In example embodiments, each of the pixel circuits may include the following elements: a first transistor including a gate terminal to which the first control signal may be applied, a first terminal connected to a first node, and a second terminal connected to a second node that is connected to a data-line through which the data signal may be transmitted; a second transistor including a gate terminal to which the second control signal may be applied, a first terminal connected to the second node, and a second terminal connected to a third node; a third transistor including a gate terminal connected to the first node, a first terminal to which the first power signal may be applied, and a second terminal connected to the third node; a storage capacitor including a first terminal to which the initialization signal may be applied and a second terminal connected to the first node; and an organic light emitting diode including an anode connected to the third node and a cathode to which the second power signal may be applied. The first control signal may have a first rising edge time and a first falling edge time in the data writing period. The first control signal may have a second rising edge time that is longer than the first rising edge time and a second falling edge time that is longer than the first falling edge time in the one or more operating periods other than the data writing period. The second control signal may have the first rising edge time and the first falling edge time.

In a pixel circuit according to example embodiments, a first transistor and a second transistor are connected in series between a gate terminal of a third transistor and a drain terminal of the third transistor. The third transistor may be a driving transistor connected in series to an organic light emitting diode. The first transistor and the second transistor may receive respective signals having different voltage levels (i.e., a high voltage level and a low voltage level) or having different edge times (i.e., a rising edge time and a falling edge time) at respective gate terminals in operating periods other than the data writing period. Advantageously, the pixel circuit may prevent a kickback phenomenon when the operating period is changed from the threshold voltage compensating period to the data writing period.

An organic light emitting display device according to example embodiments may display a high-quality image and may include the aforementioned pixel circuit.

DETAILED DESCRIPTION OF EMBODIMENTS

Embodiments are explained with reference to the accompanying drawings. In this application, the term "node" may mean "an equipotential point at which two or more circuit elements are connected"; the term "connect" may mean "electrically connect." Although the terms "first," "second," etc. may be used herein to describe various elements, these elements, should not be limited by these terms. These terms may be used to distinguish one element from another element. Thus, a first element may be termed a second element without departing from teachings of one or more embodiments. The description of an element as a "first" element may not require or imply the presence of a second element or other elements. The terms "first," "second," etc. may also be used herein to differentiate different categories or sets of elements. For conciseness, the terms "first," "second," etc. may represent "first-type (or first-set)," "second-type (or second-set)," etc., respectively.

Figure 1:
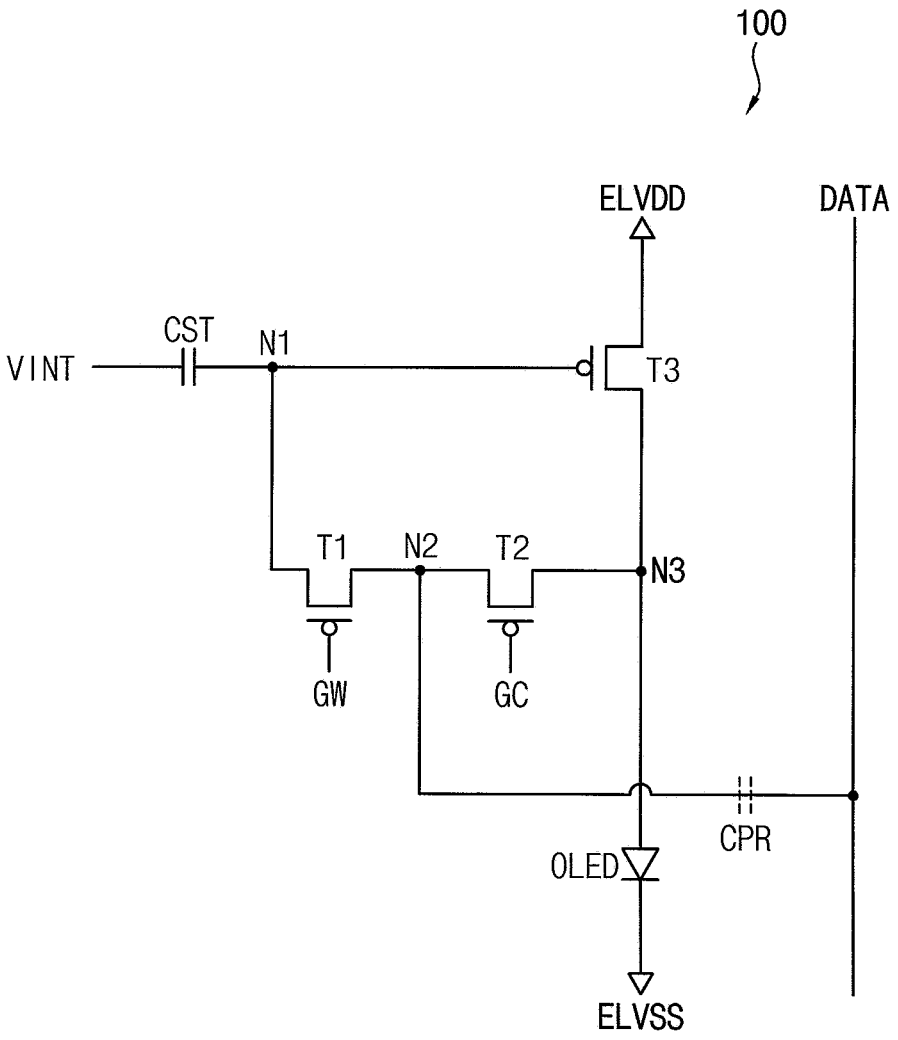
FIG. 1 is a circuit diagram illustrating a pixel circuit according to example embodiments.
Figure 2:
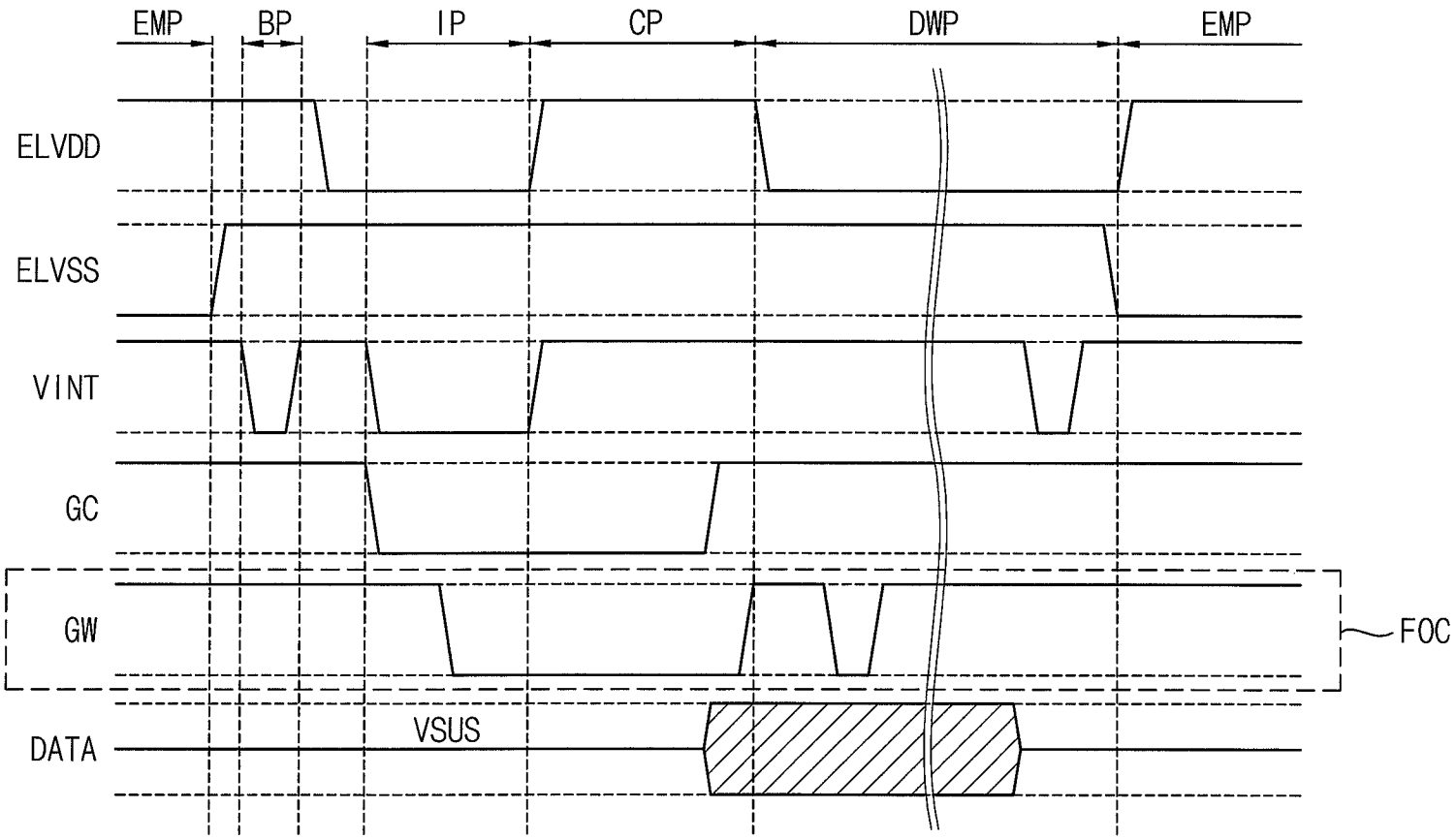
FIG. 2 is a waveform diagram illustrating an operating period of the pixel circuit of FIG. 1 according to example embodiments.

FIG. 1 is a circuit diagram illustrating a pixel circuit according to example embodiments, and FIG. 2 is a waveform diagram illustrating an operating period of the pixel circuit of FIG. 1.

Referring to FIGS. 1 and 2, the pixel circuit 100 may include a first transistor T1, a second transistor T2, a third transistor T3, a storage capacitor CST, and an organic light emitting diode (OLED). The pixel circuit 100 may sequentially perform an on-bias operation, an initializing operation, a threshold voltage compensating operation, a data writing operation, and a light emitting operation. A parasitic capacitor CPR may be unintentionally formed between a second node N2, wherein the node N2 is between the first transistor T1 and the second transistor T2 and is connected to a data-line through which a data signal DATA is transmitted. The parasitic capacitor CPR is not an (intended) element included in the pixel circuit 100. Since the pixel circuit 100 includes three transistors T1, T2, and T3 and one capacitor CST, the pixel circuit 100 may be referred to as a 3T-1C pixel circuit.

The first transistor T1 may include a gate terminal to which a first control signal GW is applied, a first terminal connected to a first node N1, and a second terminal connected to the second node N2, wherein the second node N2 is connected to the data-line through which the data signal DATA is transmitted. In an example embodiment, as illustrated in FIG. 1, the first transistor T1 may be a p-type metal oxide semiconductor (PMOS) transistor. When the first control signal GW has a low voltage level, the first transistor T1 may be turned on. On the other hand, when the first control signal GW has a high voltage level, the first transistor T1 may be turned off. In an example embodiment, the first transistor T1 may be an n-type metal oxide semiconductor (NMOS) transistor. When the first control signal GW has a high voltage level, the first transistor T1 may be turned on. On the other hand, when the first control signal GW has a low voltage level, the first transistor T1 may be turned off. In some example embodiments, the first control signal GW applied to the gate terminal of the first transistor T1 may be a global clock signal for a simultaneous emission driving. For example, when the organic light emitting display device including a plurality of pixel circuits 100 operates in a simultaneous emission driving method, the first control signal GW as the global clock signal may be commonly applied to the pixel circuits 100. The first control signal GW and the second control signal GC may be generated by separate drivers.

The second transistor T2 may include a gate terminal to which the second control signal GC is applied, a first terminal connected to the second node N2 (which is connected to the data-line through which the data signal DATA is transmitted), and a second terminal connected to the third node N3. That is, the second transistor T2 may be connected to the first transistor T1 in series between the first node N1 (or the gate terminal of the third transistor T3) and the third node N3 (or the drain terminal of the third transistor T3). The third transistor and the organic light emitting diode OLED may be connected in series. In an example embodiment, as illustrated in FIG. 1, the second transistor T2 may be a PMOS transistor. The second transistor T2 may be turned on when the second control signal GC has a low voltage level. On the other hand, the second transistor T2 may be turned off when the second control signal GC has a high voltage level. In an example embodiment, the second transistor T2 may be an NMOS transistor. The second transistor T2 may be turned on when the second control signal GC has a high voltage level. On the other hand, the second transistor T2 may be turned off when the second control signal GC has a low voltage level.

The third transistor T3 may include a gate terminal connected to the first node N1, a first terminal to which the first power signal ELVSS is applied, and a second terminal connected to the third node N3. As illustrated in FIG. 1, since the second terminal of the third transistor T3 and an anode of the organic light emitting diode OLED are connected to the third node N3, the third transistor T3 and the organic light emitting diode OLED may be connected in series between the first power signal ELVDD and the second power signal ELVSS. The third transistor T3 may be referred to as the driving transistor. That is, the third transistor T3 may control a current flowing through the organic light emitting diode OLED based on a voltage applied to the gate terminal of the third transistor T3 (i.e., a voltage applied to the first node N1). Thus, a gray-scale of the corresponding pixel may be implemented by controlling emission-luminance of the organic light emitting diode OLED. In an example embodiment, as illustrated in FIG. 1, the third transistor T3 may be a PMOS transistor. When a signal applied to the first node N1 has a low voltage level that is lower than a turn-on voltage level of the third transistor T3, the third transistor T3 may be turned on. On the other hand, when the signal applied to the first node N1 has a high voltage level that is higher than the turn-on voltage level of the third transistor T3, the third transistor T3 may be turned off. In an example embodiment, the third transistor T3 may be an NMOS transistor. In this case, when the signal applied to the first node N1 has a high voltage level that is higher than the turn-on voltage level of the third transistor T3, the third transistor T3 may be turned on. On the other hand, when the signal applied to the first node N1 has a low voltage level that is lower than the turn-on voltage level of the third transistor T3, the third transistor T3 may be turned off.

The storage capacitor CST may include a first terminal to which an initialization signal VINT is applied and a second terminal connected to the first node N1. The storage capacitor CST may store the data signal DATA that is applied through the data-line when the first transistor T1 is turned on in a data writing period DWP. When the third transistor T3 is turned on based on the data signal DATA stored in the storage capacitor CST in a light emitting period EMP, a current corresponding to the data signal DATA may flow through the organic light emitting diode OLED, and thus the organic light emitting diode OLED may emit light. The organic light emitting diode OLED may include the anode connected to the third node N3 and a cathode to which the second power signal ELVSS is applied. As described above, the pixel circuit 100 may include three transistors T1, T2, and T3, and the transistors T1, T2, and T3 may be the PMOS transistors or the NMOS transistors. In embodiments, the transistors T1, T2, and T3 included in the pixel circuit 100 are the PMOS transistors.

Figure 4:
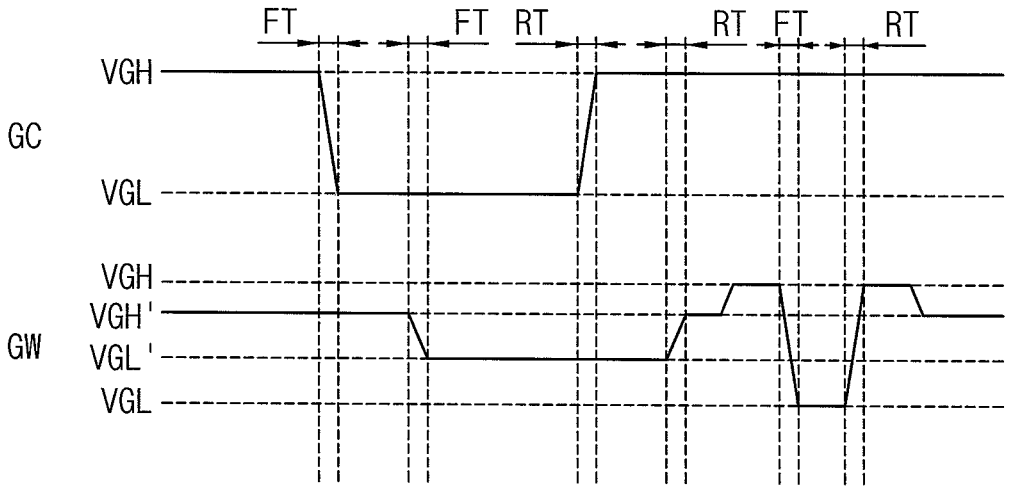
FIG. 4 is a waveform diagram illustrating an example of a first control signal applied to a gate terminal of a first transistor included in the pixel circuit of FIG. 1 according to example embodiments.
Figure 5:
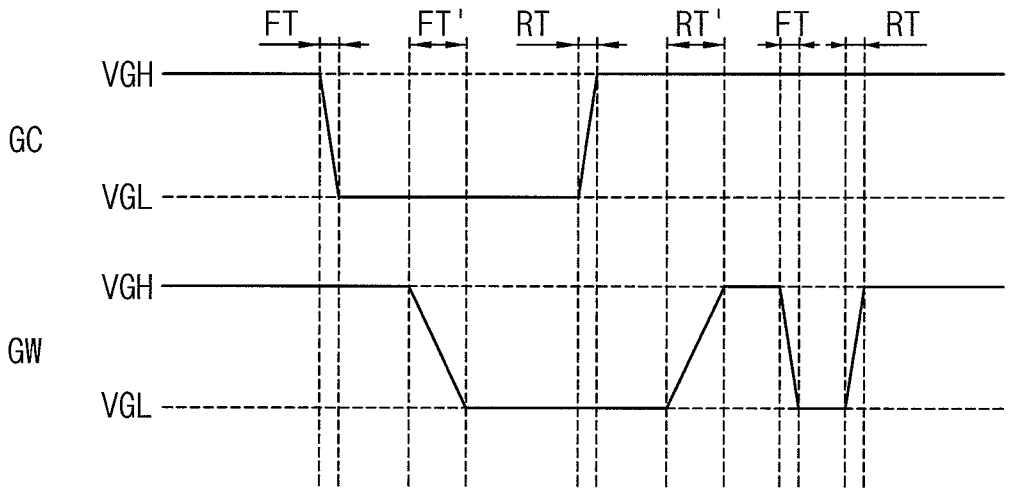
FIG. 5 is a waveform diagram illustrating an example of a first control signal applied to a gate terminal of a first transistor included in the pixel circuit of FIG. 1 according to example embodiments.
Figure 6:
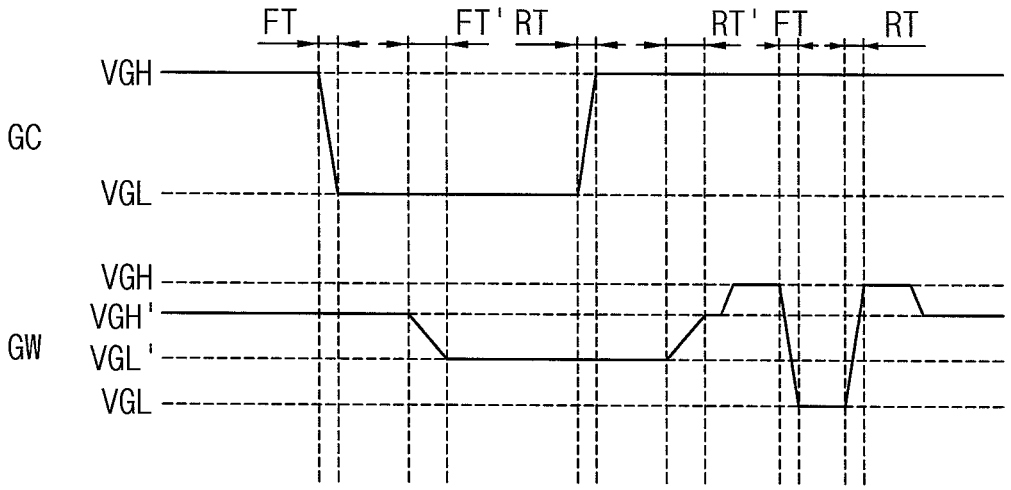
FIG. 6 is a waveform diagram illustrating an example of a first control signal applied to a gate terminal of a first transistor included in the pixel circuit of FIG. 1 according to example embodiments.

As illustrated in FIG. 2, operating periods of the pixel circuit 100 may include an on-bias period BP in which an on-bias operation is performed, an initializing period IP in which an initializing operation is performed, a threshold voltage compensating period CP in which a threshold voltage compensating operation is performed, a data writing period DWP in which a data writing operation is performed, and a light emitting period EMP in which a light emitting operation is performed. As the pixel circuit 100 sequentially performs the on-bias operation, the initializing operation, the threshold voltage compensating operation, the data writing operation, and the light emitting operation, the operating period of the pixel circuit 100 may be sequentially changed in the order of the on-bias period BP, the initializing period IP, the threshold voltage compensating period CP, the data writing period DWP, and the light emitting period EMP. In embodiments, as illustrated in FIG. 2, the first control signal GW applied to the gate terminal of the first transistor T1 and the second control signal GC applied to the gate terminal of the second transistor T2 have the same high/low voltage levels and the same rising/falling edge times (e.g., included in a sample indicated by FOC). In embodiments, as illustrated in FIGS. 4 to 6, the first control signal GW applied to the gate terminal of the first transistor T1 and the second control signal GC applied to the gate terminal of the second transistor T2 have different high voltage levels, different low voltage levels, different falling edge times, and/or different rising edge times. In sequentially performing the on-bias operation, the initializing operation, the threshold voltage compensating operation, the data writing operation, and the light emitting operation, the pixel circuit 100 may prevent a kickback phenomenon from occurring when the operation period is changed from the threshold voltage compensating period CP to the data writing period DWP.

In the operating period of the pixel circuit 100, the pixel circuit 100 may perform the on-bias operation in the on-bias period BP, may perform the initializing operation in the initializing period IP, may perform the threshold voltage compensating operation in the threshold voltage compensating period CP, may perform the data writing operation in the data writing period DWP, and may perform the light emitting operation in the light emitting period EMP. In the on-bias period BP of the pixel circuit 100, the first power signal ELVDD may have a high voltage level, the second power signal ELVSS may have a high voltage level, the initialization signal VINT may have a low voltage level, the first control signal GW may have a high voltage level, the second control signal GC may have a high voltage level, and the data signal DATA may have a predetermined sustaining voltage level VSUS. Thus, the on-bias operation may be performed in the pixel circuit 100, and a voltage characteristic curve of the third transistor T3 may be initialized to an on-bias state regardless of the data signal DATA provided in a previous frame. As a result, the pixel circuit 100 may implement desired luminance regardless of the data signal DATA provided in the previous frame. In the on-bias period BP of the pixel circuit 100, the initialization signal VINT having a low voltage level may be applied to the gate terminal of the third transistor T3. However, since both the power signals ELVDD and ELVSS have a high voltage level, the third transistor T3 (i.e., the driving transistor) may not be turned on.

Next, in the initializing period IP of the pixel circuit 100, the first power signal ELVDD may have a low voltage level, the second power signal ELVSS may have a high voltage level, the initialization signal VINT may have a low voltage level, the first control signal GW may be changed (i.e., with voltage level transition) from a high voltage level to a low voltage level, the second control signal GC may have a low voltage level, and the data signal DATA may have the sustaining voltage level VSUS. Thus, the first transistor T1 may be turned off and then turned on, and the second transistor T2 may be turned on. As a result, the gate terminal of the third transistor T3 (i.e., the first node N1), the anode of the organic light emitting diode OLED (i.e., the third node N3), and the second node N2 at which the first transistor T1 is connected to the second transistor T2 may be initialized. Subsequently, in the threshold voltage compensating period CP of the pixel circuit 100, the first power signal ELVDD may have a high voltage level, the second power signal ELVSS may have a high voltage level, the initialization signal VINT may have a high voltage level, the first control signal GW may have a low voltage level, the second control signal GC may be changed from a low voltage level to a high voltage level, and the data signal DATA may have the sustaining voltage level VSUS. Thus, the first transistor T1 may be turned on, and the second transistor T2 may be turned on and then turned off. As a result, the third transistor T3 may be diode-connected (i.e., the gate terminal of the third transistor T3 may be connected to the drain terminal of the third transistor T3), a voltage that reflects a threshold voltage of the third transistor T3 may be stored in the first node N1, and thus characteristic deviations due to the threshold voltage of the third transistor T3 may be removed.

Subsequently, in the data writing period DWP of the pixel circuit 100, the first power signal ELVDD may have a low voltage level, the second power signal ELVSS may have a high voltage level, the initialization signal VINT may be changed from a high voltage level to a low voltage level and then, when/after a specific time has elapsed, may be changed from a/the low voltage level to a/the high voltage level, the first control signal GW may be changed from a high voltage level to a low voltage level and then, when a data writing operation time has elapsed, may be changed from a/the low voltage level to a/the high voltage level, the second control signal GC may have a high voltage level, and the data signal DATA may have a voltage level corresponding to a specific gray-scale. Thus, the first transistor T1 may be turned on during the data writing operation time, and the second transistor T2 may be turned off. As a result, the data signal DATA may be stored in the storage capacitor CST during the data writing operation time during which the first transistor T1 is turned on. As described above, the initialization signal VINT may have a low voltage level during the specific time. Hence, the anode of the organic light emitting diode OLED may be initialized again during the specific time. Next, in the light emitting period EMP of the pixel circuit 100, the first power signal ELVDD may have a high voltage level, the second power signal ELVSS may have a low voltage level, the initialization signal VINT may have a high voltage level, the first control signal GW may have a high voltage level, the second control signal GC may have a high voltage level, and the data signal DATA may have the sustaining voltage level VSUS. Thus, the third transistor T3 may be turned on based on the data signal DATA stored in the storage capacitor CST. As a result, a current may flow through the organic light emitting diode OLED, and thus the organic light emitting diode OLED may emit light.

In a comparative pixel circuit (e.g., included in a comparative organic light emitting display device) according to embodiments, the first control signal GW applied to the gate terminal of the first transistor T1 and the second control signal GC applied to the gate terminal of the second transistor T2 have the same high voltage level, the same low voltage level, the same rising edge time, and the same falling edge time. Thus, when the operating period of the pixel circuit is changed from the threshold voltage compensating period CP to the data writing period DWP, the kickback phenomenon may occur in the pixel circuit, and thus luminance non-uniformity due to a luminance change of the pixel circuit may be caused. In other words, when the operating period is changed from the threshold voltage compensating period CP to the data writing period DWP, the voltage stored in the storage capacitor CST may be distributed to the parasitic capacitor CPR due to a direction change of a leakage current at the timing when a state of the first transistor T1 is changed from a turn-on state to a turn-off state. Thus, the luminance change may be caused by a change in the voltage stored in the storage capacitor CST. In embodiments, because the first transistor T1 is in a turn-off state at the timing when a state of the second transistor T2 is changed from a turn-on state to a turn-off state, a kickback phenomenon due to the turn-off operation of the second transistor T2 may not be a serious problem as compared to the comparative pixel circuit. For minimizing effects of the kickback phenomenon, the pixel circuit 100 may have a structure in which the first and second transistors T1 and T2 are connected in series between the gate terminal of the third transistor T3 and the drain terminal of the third transistor T3, the third transistor T3 and the organic light emitting diode OLED are connected in series, and the first and second transistor T1 and T2 receive signals having different high voltage levels, different low voltage levels, different rising edge times, and/or different falling edge times at respective gate terminals in one or more operating periods other than the data writing period DWP.

In an example embodiment, the first control signal GW applied to the gate terminal of the first transistor T1 may have a first high voltage level and a first low voltage level in the data writing period DWP in which the data writing operation is performed and may have a second high voltage level (lower than the first high voltage level) and a second low voltage level (higher than the first low voltage level) in one or more operating periods other than the data writing period DWP. The second control signal GC applied to the gate terminal of the second transistor T2 may have the first high voltage level and the first low voltage level. That is, in the pixel circuit 100, the first and second transistors T1 and T2 may receive respective signals having different high/low voltage levels at respective gate terminals in one or more operating periods other than the data writing period DWP. In an example embodiment, in one or more operating periods other than the data writing period DWP, the rising edge time of the first control signal GW may be the same as the rising edge time of the second control signal GC, and the falling edge time of the first control signal GW may be the same as the falling edge time of the second control signal GC. In example embodiments, in one or more operating periods other than the data writing period DWP, the rising edge time of the first control signal GW may be different from the rising edge time of the second control signal GC, and the falling edge time of the first control signal GW may be different from the falling edge time of the second control signal GC. In some example embodiments, as illustrated in FIGS. 2, 4, and 6, in the initializing period IP, the first control signal GW may be changed from the second high voltage level to the second low voltage level after the second control signal GC is changed from the first high voltage level to the first low voltage level. Subsequently, in the threshold voltage compensating period CP, the first control signal GW may be changed from the second low voltage level to the second high voltage level after the second control signal GC is changed from the first low voltage level to the first high voltage level. Next, between the threshold voltage compensating period CP and the data writing period DWP, the first control signal GW may be changed from the second high voltage level to the first high voltage level. Subsequently, in the data writing period DWP, the first control signal GW may be changed from the first high voltage level to the first low voltage level and then, when/after the data writing operation time has elapsed, may be changed from the first low voltage level to the first high voltage level. Next, between the data writing period DWP and the light emitting period EMP, the first control signal GW may be changed from the first high voltage level to the second high voltage level.

In example embodiments, the first control signal GW applied to the gate terminal of the first transistor T1 may have a first rising edge time and a first falling edge time in the data writing period DWP in which the data writing operation is performed and may have a second rising edge time (longer than the first rising edge time) and a second falling edge time (longer than the first falling edge time) in one or more operating periods other than the data writing period DWP. The second control signal GC applied to the gate terminal of the second transistor T2 may have the first rising edge time and the first falling edge time. That is, in the pixel circuit 100, the first and second transistors T1 and T2 may receive respective signals having different rising/falling edge times at respective gate terminals in the one or more operating periods other than the data writing period DWP. A high voltage level of the first control signal GW may be the same as a high voltage level of the second control signal GC, and a low voltage level of the first control signal GW may be the same as a low voltage level of the second control signal GC. In some example embodiments, as illustrated in FIGS. 2 and 5, in the initializing period IP, the first control signal GW may be changed from a high voltage level to a low voltage level after the second control signal GC is changed from a high voltage level to a low voltage level. Subsequently, in the threshold voltage compensating period CP, the first control signal GW may be changed from a low voltage level to a high voltage level after the second control signal GC is changed from a low voltage level to a high voltage level. Next, in the data writing period DWP, the first control signal GW may be changed from a high voltage level to a low voltage level and then, when the data writing operation time elapses, may be changed from a low voltage level to a high voltage level. As described above, the pixel circuit 100 may sequentially perform the on-bias operation, the initializing operation, the threshold voltage compensating operation, the data writing operation, and the light emitting operation. The pixel circuit 100 may prevent the kickback phenomenon from occurring when the operating period is changed from the threshold voltage compensating period CP to the data writing period DWP. A sample indicated by the dotted box FOC shown in FIG. 2 will be described in detail with reference to FIGS. 3 to 6. As described with reference to FIG. 2, in embodiments, the pixel circuit 100 sequentially performs the on-bias operation, the initializing operation, the threshold voltage compensating operation, the data writing operation, and the light emitting operation. The waveforms of the first power signal ELVDD, the second power signal ELVSS, the initialization signal VINT, the first control signal GW, the second control signal GC, and the data signal DATA shown in FIG. 2 are examples. The waveforms of the first power signal ELVDD, the second power signal ELVSS, the initialization signal VINT, the first control signal GW, the second control signal GC, and the data signal DATA may be designed in various ways when the pixel circuit 100 sequentially performs the on-bias operation, the initializing operation, the threshold voltage compensating operation, the data writing operation, and the light emitting operation.

Figure 3:
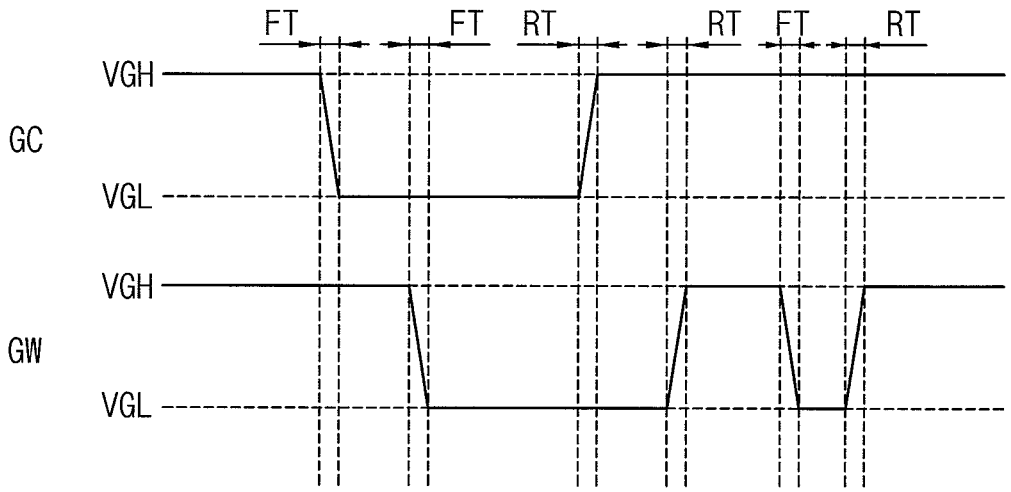
FIG. 3 (PRIOR ART)
FIG. 3 is a waveform diagram illustrating an example of a first control signal applied to a gate terminal of a first transistor included in a comparative pixel circuit according to example embodiments.

FIG. 3 is a waveform diagram illustrating an example of a first control signal applied to a gate terminal of a first transistor included in a comparative pixel circuit according to embodiments, FIG. 4 is a waveform diagram illustrating an example of a first control signal applied to a gate terminal of a first transistor included in the pixel circuit of FIG. 1 according to embodiments, FIG. 5 is a waveform diagram illustrating an example of a first control signal applied to a gate terminal of a first transistor included in the pixel circuit of FIG. 1 according to embodiments, and FIG. 6 is a waveform diagram illustrating an example of a first control signal applied to a gate terminal of a first transistor included in the pixel circuit of FIG. 1 according to embodiments.

Referring to FIGS. 3 to 6, the first control signal GW applied to the gate terminal of the first transistor T1 and the second control signal GC applied to the gate terminal of the second transistor T2 in the on-bias period BP, the initializing period IP, the threshold voltage compensating period CP, the data writing period DWP, and the light emitting period EMP are illustrated.

As illustrated in FIG. 3, in the comparative pixel circuit according to embodiments, the first control signal GW applied to the gate terminal of the first transistor T1 and the second control signal GC applied to the gate terminal of the second transistor T2 may have the same high/low voltage levels and the same falling/rising edge times in all operating periods BP, IP, CP, DWP, and EMP (i.e., the data writing period DWP and the operating periods BP, IP, CP, and EMP other than the data writing period DWP). Specifically, in the data writing period DWP and the operating periods BP, IP, CP, and EMP other than the data writing period DWP, the first control signal GW applied to the gate terminal of the first transistor T1 may have the first high voltage level VGH and the first low voltage level VGL and may have a first falling edge time FT and a first rising edge time RT. Similarly, in the data writing period DWP and the operating periods BP, IP, CP, and EMP other than the data writing period DWP, the second control signal GC applied to the gate terminal of the second transistor T2 may have the first high voltage level VGH and the first low voltage level VGL and may have the first falling edge time FT and the first rising edge time RT. As illustrated in FIG. 3, in the initializing period IP, the first control signal GW may be changed from the first high voltage level VGH to the first low voltage level VGL after the second control signal GC is changed from the first high voltage level VGH to the first low voltage level VGL. Subsequently, in the threshold voltage compensating period CP, the first control signal GW may be changed from the first low voltage level VGL to the first high voltage level VGH after the second control signal GC is changed from the first low voltage level VGL to the first high voltage level VGH. Because the first transistor T1 is in a turn-off state at the timing when a state of the second transistor T2 is changed from a turn-on state to a turn-off state in response to the second control signal GC as the operating period of the comparative pixel circuit is changed from the threshold voltage compensating period CP to the data writing period DWP, a kickback phenomenon due to the turn-off operation of the second transistor T2 may not be a serious problem. However, at the timing when a state of the first transistor T1 is changed from a turn-on state to a turn-off state in response to the first control signal GW as the operating period of the comparative pixel circuit is changed from the threshold voltage compensating period CP to the data writing period DWP, an unintentional luminance-change may be caused by the kickback phenomenon due to the turn-off operation of the first transistor T1.

In an example embodiment, as illustrated in FIG. 4, in the pixel circuit 100 of FIG. 1, the first control signal GW applied to the gate terminal of the first transistor T1 and the second control signal GC applied to the gate terminal of the second transistor T2 may have different high/low voltage levels and the same edge times in the operating periods BP, IP, CP, and EMP other than the data writing period DWP. Specifically, in the data writing period DWP, the first control signal GW applied to the gate terminal of the first transistor T1 may have the first high voltage level VGH and the first low voltage level VGL and may have the first falling edge time FT and the first rising edge time RT. However, in the operating periods BP, IP, CP, and EMP other than the data writing period DWP, the first control signal GW applied to the gate terminal of the first transistor T1 may have the second high voltage level VGH' that is lower than the first high voltage level VGH and the second low voltage level VGL' that is higher than the first low voltage level VGL and may have the first falling edge time FT and the first rising edge time RT. Here, in the data writing period DWP and the operation periods BP, IP, CP, and EMP other than the data writing period DWP, the second control signal GC applied to the gate terminal of the second transistor T2 may have the first high voltage level VGH and the first low voltage level VGL and may have the first falling edge time FT and the first rising edge time RT. As illustrated in FIG. 4, in the initializing period IP, the first control signal GW may be changed from the second high voltage level VGH' to the second low voltage level VGL' after the second control signal GC is changed from the first high voltage level VGH to the first low voltage level VGL. Subsequently, in the threshold voltage compensating period CP, the first control signal GW may be changed from the second low voltage level VGL' to the second high voltage level VGH' after the second control signal GC is changed from the first low voltage level VGL to the first high voltage level VGH. Next, between the threshold voltage compensating period CP and the data writing period DWP, the first control signal GW may be changed from the second high voltage level VGH' to the first high voltage level VGH. Subsequently, between the data writing period DWP and the light emitting period EMP, the first control signal GW may be changed from the first high voltage level VGH to the second high voltage level VGH'. As described above, when the state of the first transistor T1 is changed from the turn-on state to the turn-off state as the operating period is changed from the threshold voltage compensating period CP to the data writing period DWP, a voltage level fluctuating width of the first control voltage GW applied to the gate terminal of the first transistor T1 may be relatively small in the pixel circuit 100 of FIG. 1 as compared to the convention pixel circuit. Thus, the kickback phenomenon due to the turn-off operation of the first transistor T1 may be prevented or minimized.

In embodiments, as illustrated in FIG. 5, in the pixel circuit 100 of FIG. 1, the first control signal GW applied to the gate terminal of the first transistor T1 and the second control signal GC applied to the gate terminal of the second transistor T2 may have the same voltage levels and different falling/rising edge times in the operating periods BP, IP, CP, and EMP other than the data writing period DWP. Specifically, in the data writing period DWP, the first control signal GW applied to the gate terminal of the first transistor T1 may have the first falling edge time FT and the first rising edge time RT and may have the first high voltage level VGH and the first low voltage level VGL. However, in the operating periods BP, IP, CP, and EMP other than the data writing period DWP, the first control signal GW applied to the gate terminal of the first transistor T1 may have the second rising edge time RT' that is longer than the first rising edge time RT and the second falling edge time FT' that is longer than the first falling edge time FT and may have the first high voltage level VGH and the first low voltage level VGL. Here, in the data writing period DWP and the operation periods BP, IP, CP, and EMP other than the data writing period DWP, the second control signal GC applied to the gate terminal of the second transistor T2 may have the first high voltage level VGH and the first low voltage level VGL and may have the first falling edge time FT and the first rising edge time RT. As illustrated in FIG. 5, in the initializing period IP, the first control signal GW may be changed from the first high voltage level VGH to the first low voltage level VGL after the second control signal GC is changed from the first high voltage level VGH to the first low voltage level VGL. Subsequently, in the threshold voltage compensating period CP, the first control signal GW may be changed from the first low voltage level VGL to the first high voltage level VGH after the second control signal GC is changed from the first low voltage level VGL to the first high voltage level VGH. As described above, when the state of the first transistor T1 is changed from the turn-on state to the turn-off state as the operating period is changed from the threshold voltage compensating period CP to the data writing period DWP, a voltage level fluctuating time of the first control voltage GW applied to the gate terminal of the first transistor T1 may be relatively long in the pixel circuit 100 of FIG. 1 as compared to the convention pixel circuit. Thus, the kickback phenomenon due to the turn-off operation of the first transistor T1 may be reduced.

In example embodiments, as illustrated in FIG. 6, in the pixel circuit 100 of FIG. 1, the first control signal GW applied to the gate terminal of the first transistor T1 and the second control signal GC applied to the gate terminal of the second transistor T2 may have different high/low voltage levels and different falling/rising edge times in the operating periods BP, IP, CP, and EMP other than the data writing period DWP. Specifically, in the data writing period DWP, the first control signal GW applied to the gate terminal of the first transistor T1 may have the first high voltage level VGH and the first low voltage level VGL and may have the first falling edge time FT and the first rising edge time RT. However, in the operating periods BP, IP, CP, and EMP other than the data writing period DWP, the first control signal GW applied to the gate terminal of the first transistor T1 may have the second high voltage level VGH' that is lower than the first high voltage level VGH and the second low voltage level VGL' that is higher than the first low voltage level VGL and may have the second falling edge time FT' that is longer than the first falling edge time FT and the second rising edge time RT' that is longer than the first rising edge time RT. Here, in the data writing period DWP and the operation periods BP, IP, CP, and EMP other than the data writing period DWP, the second control signal GC applied to the gate terminal of the second transistor T2 may have the first high voltage level VGH and the first low voltage level VGL and may have the first falling edge time FT and the first rising edge time RT. As illustrated in FIG. 6, in the initializing period IP, the first control signal GW may be changed from the second high voltage level VGH' to the second low voltage level VGL' after the second control signal GC is changed from the first high voltage level VGH to the first low voltage level VGL. Subsequently, in the threshold voltage compensating period CP, the first control signal GW may be changed from the second low voltage level VGL' to the second high voltage level VGH' after the second control signal GC is changed from the first low voltage level VGL to the first high voltage level VGH. Next, between the threshold voltage compensating period CP and the data writing period DWP, the first control signal GW may be changed from the second high voltage level VGH' to the first high voltage level VGH. Subsequently, between the data writing period DWP and the light emitting period EMP, the first control signal GW may be changed from the first high voltage level VGH to the second high voltage level VGH'. As described above, when the state of the first transistor T1 is changed from the turn-on state to the turn-off state as the operating period is changed from the threshold voltage compensating period CP to the data writing period DWP, the voltage level fluctuating width of the first control voltage GW applied to the gate terminal of the first transistor T1 may be relatively small, and the voltage level fluctuating time of the first control voltage GW applied to the gate terminal of the first transistor T1 may be relatively long in the pixel circuit 100 of FIG. 1 as compared to the convention pixel circuit. Thus, the kickback phenomenon due to the turn-off operation of the first transistor T1 may be reduced.

Figure 7:
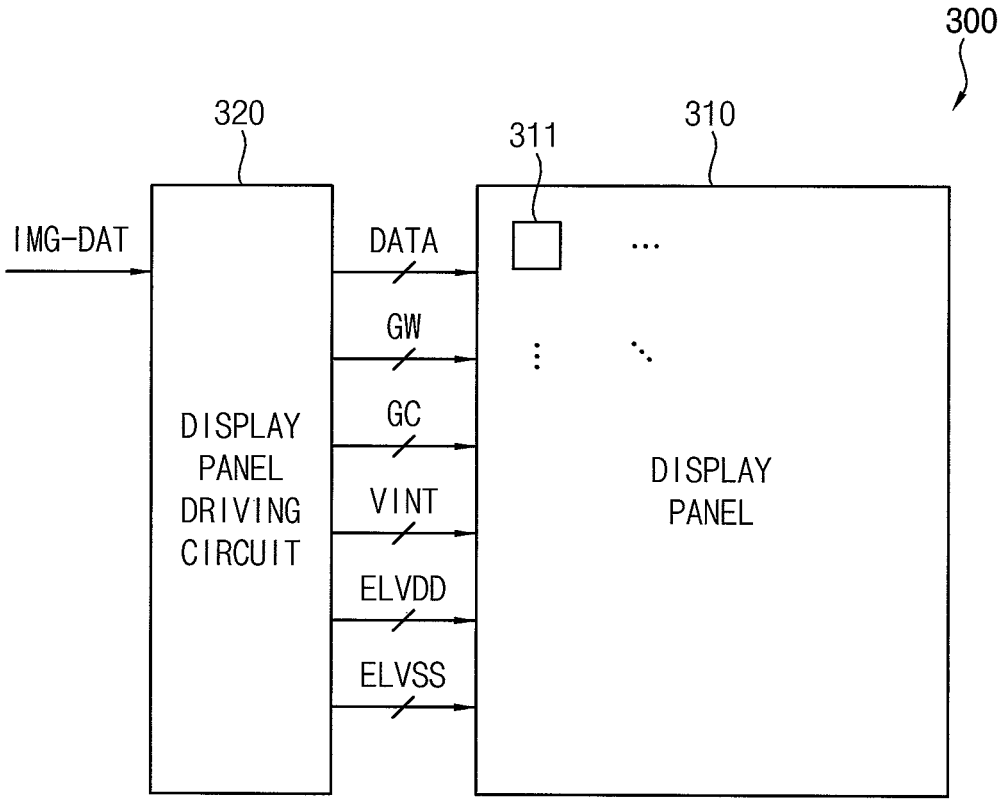
FIG. 7 is a block diagram illustrating an organic light emitting display device according to example embodiments.

FIG. 7 is a block diagram illustrating an organic light emitting display device according to example embodiments.

Referring to FIG. 7, the organic light emitting display device 300 may include a display panel 310 and a display panel driving circuit 320.

The display panel 310 may include a plurality of pixel circuits 311 that sequentially perform an on-bias operation, an initializing operation, a threshold voltage compensating operation, a data writing operation, and a light emitting operation. In some example embodiments, the pixel circuits 311 may be arranged in a matrix form in the display panel 310. The display panel driving circuit 320 may drive the display panel 310 by providing a data signal DATA, an initialization signal VINT, a first control signal GW, a second control signal GC, a first power signal ELVDD, and a second power signal ELVSS to the pixel circuits 311. For this operation, the display panel driving circuit 320 may include a data driver, a scan driver, an emission controller, a timing controller, a power supply, etc. Since the elements of the display panel driving circuit 320 are examples, the elements of the display panel driving circuit 320 are not limited thereto. The display panel driving circuit 320 may provide the first and second control signals GW and GC having the same voltage levels (i.e., a high voltage level and a low voltage level) and the same edge times (i.e., a rising edge time and a falling edge time) to the pixel circuits 311 of the display panel 310 in a data writing period in which the data writing operation is performed. In addition, the display panel driving circuit 320 may provide the first and second control signal GW and GC having different voltage levels and different edge times to the pixel circuits 311 of the display panel 310 in operating periods other than the data writing period. For example, when the organic light emitting display device 300 operates in a simultaneous emission driving method, the first control signal GW may be a global clock signal for a simultaneous emission driving. That is, the first control signal GW as the global clock signal may be commonly applied to the pixel circuits 100. The first control signal GW and the second control signal GC may be generated by separate drivers. In some example embodiments, to provide the first control signal GW having different waveforms between the data writing period and the operating periods other than the data writing period, the display panel driving circuit 320 may include a voltage generating circuit or a diode to generate different voltage levels.

In an example embodiment, each of the pixel circuits 311 included in the display panel 310 may include a first transistor, a second transistor, a third transistor, a storage capacitor, and an organic light emitting diode. A pixel circuit 311 may have structures and/or features analogous to or identical to the structures and/or features of the pixel circuit 100 according to one or more embodiments discussed above. The first transistor may include a gate terminal to which the first control signal GW is applied, a first terminal connected to a first node, and a second terminal connected to a second node that is connected to a data-line through which the data signal DATA is transmitted. The second transistor may include a gate terminal to which the second control signal GC is applied, a first terminal connected to the second node, and a second terminal connected to a third node. The third transistor may include a gate terminal connected to the first node, a first terminal to which the first power signal ELVDD is applied, and a second terminal connected to the third node. The storage capacitor may include a first terminal to which the initialization signal VINT is applied and a second terminal connected to the first node. The organic light emitting diode may include an anode connected to the third node and a cathode to which the second power signal ELVSS is applied. The first control signal GW applied to the gate terminal of the first transistor may have a first high voltage level and a first low voltage level in the data writing period and may have a second high voltage level that is lower than the first high voltage level and a second low voltage level that is higher than the first low voltage level in the operating periods other than the data writing period. In addition, the second control signal GC applied to the gate terminal of the second transistor may have the first high voltage level and the first low voltage level. In other words, the display panel driving circuit 320 may provide the first and second control signals GW and GC having the same voltage levels and the same edge times to the pixel circuits 311 of the display panel 310 in the data writing period. In addition, the display panel driving circuit 320 may provide the first and second control signals GW and GC having different voltage levels to the pixel circuits 311 of the display panel 310 in the operating periods other than the data writing period.

In an example embodiment, each of the pixel circuits 311 included in the display panel 310 may include a first transistor, a second transistor, a third transistor, a storage capacitor, and an organic light emitting diode. The first transistor may include a gate terminal to which the first control signal GW is applied, a first terminal connected to a first node, and a second terminal connected to a second node that is connected to the data-line through which the data signal DATA is transmitted. The second transistor may include a gate terminal to which the second control signal GC is applied, a first terminal connected to the second node, and a second terminal connected to a third node. The third transistor may include a gate terminal connected to the first node, a first terminal to which the first power signal ELVDD is applied, and a second terminal connected to the third node. The storage capacitor may include a first terminal to which the initialization signal VINT is applied and a second terminal connected to the first node. The organic light emitting diode may include an anode connected to the third node and a cathode to which the second power signal ELVSS is applied. The first control signal GW applied to the gate terminal of the first transistor may have a first rising edge time and a first falling edge time in the data writing period and may have a second rising edge time that is longer than the first rising edge time and a second falling edge time that is longer than the first falling edge time in the operating periods other than the data writing period. In addition, the second control signal GC applied to the gate terminal of the second transistor may have the first rising edge time and the first falling edge time. In other words, the display panel driving circuit 320 may provide the first and second control signals GW and GC having the same voltage levels and the same edge times to the pixel circuits 311 of the display panel 310 in the data writing period. In addition, the display panel driving circuit 320 may provide the first and second control signals GW and GC having different edge times to the pixel circuits 311 of the display panel 310 in the operating periods other than the data writing period. As described above, the organic light emitting display device 300 may provide a high-quality image to a viewer (or, user) by including the pixel circuits 311 that can prevent a kickback phenomenon from occurring when the operating period is changed from the threshold voltage compensating period to the data writing period, where each of the pixel circuits 311 sequentially performs the on-bias operation, the initializing operation, the threshold voltage compensating operation, the data writing operation, and the light emitting operation.

Figure 8:
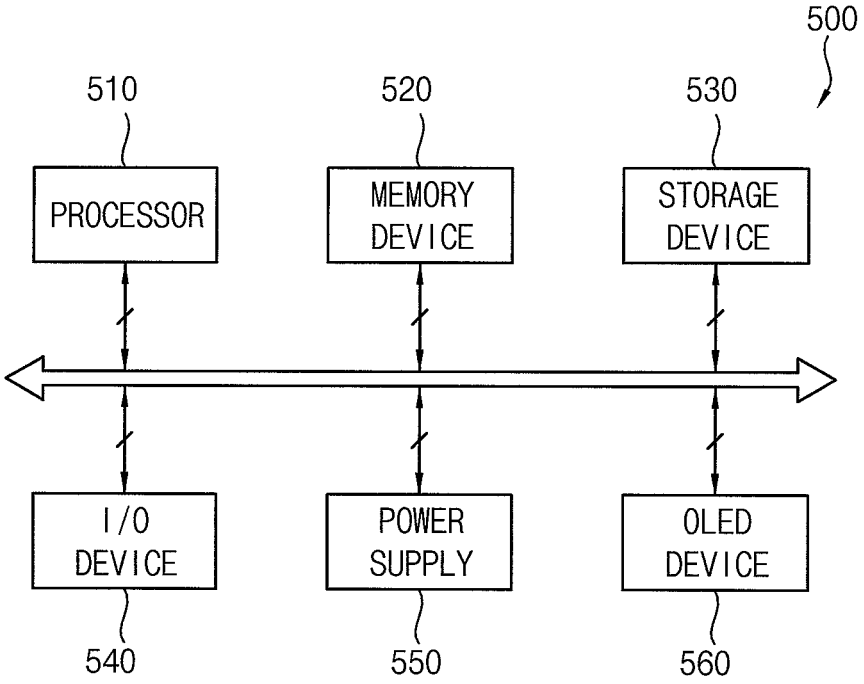
FIG. 8 is a block diagram illustrating an electronic device according to example embodiments.
Figure 9:
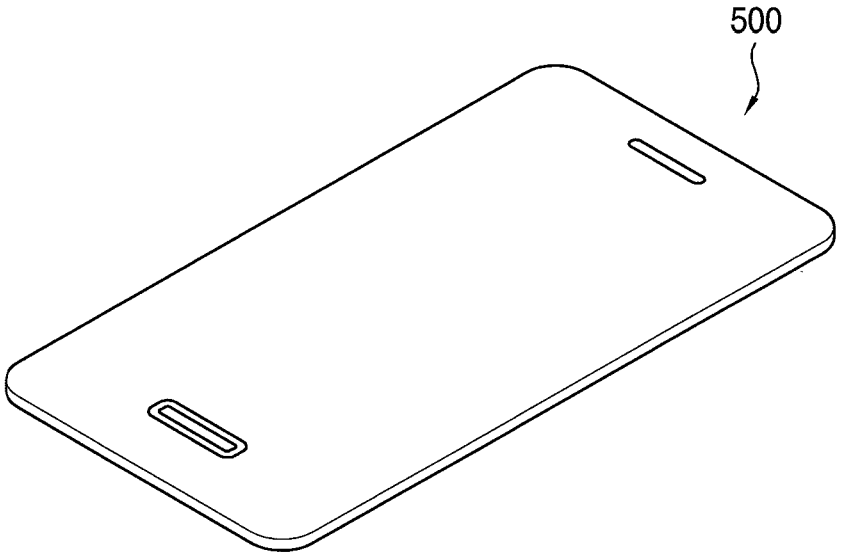
FIG. 9 is a diagram illustrating an example in which the electronic device of FIG. 8 is implemented as a smart phone according to example embodiments.
Figure 10:
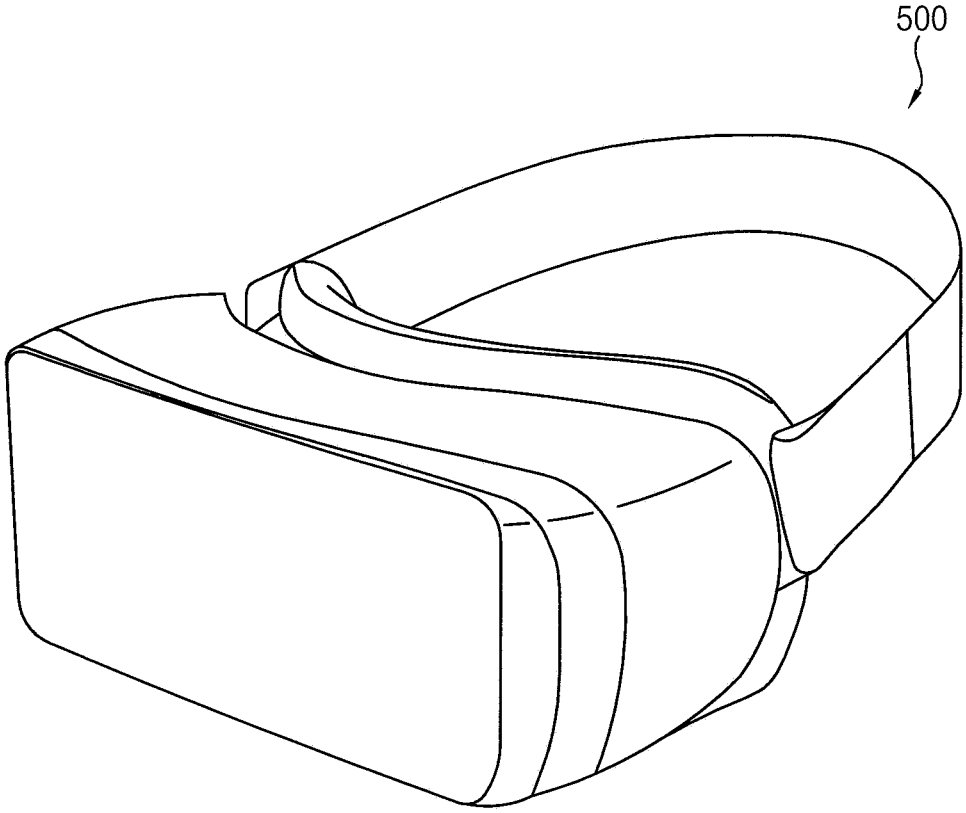
FIG. 10 is a diagram illustrating an example in which the electronic device of FIG. 8 is implemented as a head mounted display (HMD) device according to example embodiments.

FIG. 8 is a block diagram illustrating an electronic device according to example embodiments, FIG. 9 is a diagram illustrating an example in which the electronic device of FIG. 8 is implemented as a smart phone, and FIG. 10 is a diagram illustrating an example in which the electronic device of FIG. 8 is implemented as an HMD device.

Referring to FIGS. 8 to 10, the electronic device 500 may include a processor 510, a memory device 520, a storage device 530, an input/output (I/O) device 540, a power supply 550, and an organic light emitting display device 560. The organic light emitting display device 560 may be the organic light emitting display device 300 of FIG. 7. In addition, the electronic device 500 may further include a plurality of ports for communicating with a video card, a sound card, a memory card, a universal serial bus (USB) device, other electronic devices, etc. In an example embodiment, as illustrated in FIG. 9, the electronic device 500 may be implemented as a smart phone. In an example embodiment, as illustrated in FIG. 10, the electronic device 500 may be implemented as an HMD device. In embodiments, the electronic device 500 may be implemented as one or more of a cellular phone, a video phone, a smart pad, a smart watch, a tablet PC, a car navigation system, a television, a computer monitor, a laptop, etc.

The processor 510 may perform various computing functions. The processor 510 may be a microprocessor, a central processing unit (CPU), an application processor (AP), etc. The processor 510 may be coupled to other components via an address bus, a control bus, a data bus, etc. Further, the processor 510 may be coupled to an extended bus such as a peripheral component interconnection (PCI) bus. The memory device 520 may store data for operations of the electronic device 500. For example, the memory device 520 may include at least one non-volatile memory device such as one of an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc., and/or at least one volatile memory device such as a dynamic random access memory (DRAM) device, a static random access memory (SRAM) device, a mobile DRAM device, etc. The storage device 530 may be one of a solid state drive (SSD) device, a hard disk drive (HDD) device, a CD-ROM device, etc. The I/O device 540 may be an input device such as one of a keyboard, a keypad, a mouse device, a touchpad, a touch-screen, etc., and an output device such as one of a printer, a speaker, etc. In some example embodiments, the organic light emitting display device 560 may be included in the I/O device 540. The power supply 550 may provide power for operations of the electronic device 500.

The organic light emitting display device 560 may be coupled to other components via the buses or other communication links. Specifically, the organic light emitting display device 560 may include pixel circuits each having a structure in which first and second transistors are connected in series between a gate terminal and a drain terminal of a third transistor connected in series to an organic light emitting diode and the first and second transistors receive respective signals having different voltage levels or having different edge times at respective gate terminals in operating periods other than a data writing period. Here, each of the pixel circuits may sequentially perform an on-bias operation, an initializing operation, a threshold voltage compensating operation, the data writing operation, and a light emitting operation. As a result, since the pixel circuits can prevent a kickback phenomenon from occurring when the operating period is changed from the threshold voltage compensating period to the data writing period, the organic light emitting display device 560 including the pixel circuits may display a high-quality image. In example embodiments, the organic light emitting display device 560 may include a display panel that includes the pixel circuits and a display panel driving circuit that drives the display panel by providing a data signal, an initialization signal, a first control signal, a second control signal, a first power signal, and a second power signal to the pixel circuits. The first control signal and the second control signal may have the same voltage levels and the same edge times in the data writing period in which the data writing operation is performed. In addition, the first control signal and the second control signal may have different voltage levels and different edge times in the operating periods other than the data writing period. Since a structure of each pixel circuit included in the organic light emitting display device 560 is described above, duplicated description will not be repeated.

Embodiments may be related to an organic light emitting display device and an electronic device including the organic light emitting display device. For example, embodiments may be related to one or more of a cellular phone, a smart phone, a video phone, a smart pad, a smart watch, a tablet PC, a car navigation system, a television, a computer monitor, a laptop, an HMD device, etc.

The foregoing is illustrative of embodiments and is not to be construed as limiting. Although example embodiments have been described, those skilled in the art will readily appreciate that many modifications are possible in the described embodiments. All such modifications are intended to be included within the scope defined in the claims.

What is claimed is:

1. A pixel circuit comprising:

a first node;

a second node electrically connected to a data line that is configured to transmit a data signal;

a third node;

a first transistor including a gate terminal configured to receive a first control signal, a first terminal electrically connected to the first node, and a second terminal electrically connected to the second node;

a second transistor including a gate terminal configured to receive a second control signal, a first terminal electrically connected to the second node, and a second terminal electrically connected to the third node;

a third transistor including a gate terminal electrically connected to the first node, a first terminal configured to receive a first power signal, and a second terminal electrically connected to the third node;

a storage capacitor including a first terminal configured to receive an initialization signal and a second terminal electrically connected to the first node; and an organic light emitting diode including an anode electrically connected to the third node and a cathode configured to receive a second power signal, wherein the first control signal has a first high voltage level and a first low voltage level in a data writing period in which a data writing operation is performed, wherein the first high voltage level is higher than the first low voltage level, wherein the first control signal has a second high voltage level and a second low voltage level in one or more operating periods other than the data writing period, wherein the second high voltage level is lower than the first high voltage level, wherein the second low voltage level is higher than the first low voltage level, and wherein the second control signal has the first high voltage level and the first low voltage level.

2. The pixel circuit of claim 1, wherein the first control signal is a global clock signal for a simultaneous emission driving.

3. The pixel circuit of claim 1, wherein in the one or more operating periods other than the data writing period, a rising edge time of the first control signal is the same as a rising edge time of the second control signal, and a falling edge time of the first control signal is the same as a falling edge time of the second control signal.

4. The pixel circuit of claim 1, wherein in the one or more operating periods other than the data writing period, a rising edge time of the first control signal is longer than a rising edge time of the second control signal, and a falling edge time of the first control signal is longer than a falling edge time of the second control signal.

5. The pixel circuit of claim 1, wherein the first transistor, the second transistor, and the third transistor are p-type metal oxide semiconductor transistors.

6. The pixel circuit of claim 5, wherein in an initializing period in which an initializing operation is performed, the first control signal is changed from the second high voltage level to the second low voltage level after the second control signal is changed from the first high voltage level to the first low voltage level.

7. The pixel circuit of claim 6, wherein in a threshold voltage compensating period in which an threshold voltage compensating operation is performed, the first control signal is changed from the second low voltage level to the second high voltage level after the second control signal is changed from the first low voltage level to the first high voltage level.

8. The pixel circuit of claim 7, wherein between the threshold voltage compensating period and the data writing period, the first control signal is changed from the second high voltage level to the first high voltage level.

9. The pixel circuit of claim 8, wherein in the data writing period, the first control signal is changed from the first low voltage level to the first high voltage level when a data writing operation time elapses after the first control signal is changed from the first high voltage level to the first low voltage level.

10. The pixel circuit of claim 9, wherein between the data writing period and a light emitting period in which a light emitting operation is performed, the first control signal is changed from the first high voltage level to the second high voltage level.

11. A pixel circuit comprising:

a first node;

a second node electrically connected to a data line that is configured to transmit a data signal;

a third node; a first transistor including a gate terminal configured to receive a first control signal, a first terminal electrically connected to the first node, and a second terminal electrically connected to the second node;

a second transistor including a gate terminal configured to receive a second control signal, a first terminal electrically connected to the second node, and a second terminal electrically connected to the third node;

a third transistor including a gate terminal electrically connected to the first node, a first terminal configured to receive a first power signal, and a second terminal electrically connected to the third node;

a storage capacitor including a first terminal configured to receive an initialization signal and a second terminal electrically connected to the first node; and an organic light emitting diode including an anode electrically connected to the third node and a cathode configured to receive a second power signal, wherein the first control signal has a first rising edge time and a first falling edge time in a data writing period in which a data writing operation is performed, wherein the first control signal has a second rising edge time and a second falling edge time in one or more operating periods other than the data writing period, wherein the second rising edge time is longer than the first rising edge time, wherein the second falling edge time is longer than the first falling edge time, and wherein the second control signal has the first rising edge time and the first falling edge time.

12. The pixel circuit of claim 11, wherein the first control signal is a global clock signal for a simultaneous emission driving.

13. The pixel circuit of claim 11, wherein a high voltage level of the first control signal is the same as a high voltage level of the second control signal, and a low voltage level of the first control signal is the same as a low voltage level of the second control signal.

14. The pixel circuit of claim 11, wherein the first transistor, the second transistor, and the third transistor are p-type metal oxide semiconductor transistors.

15. The pixel circuit of claim 14, wherein in an initializing period in which an initializing operation is performed, the first control signal is changed from the high voltage level to the low voltage level after the second control signal is changed from the high voltage level to the low voltage level.

16. The pixel circuit of claim 15, wherein in a threshold voltage compensating period in which a threshold voltage compensating operation is performed, the first control signal is changed from the low voltage level to the high voltage level after the second control signal is changed from the low voltage level to the high voltage level.

17. The pixel circuit of claim 16, wherein in the data writing period, the first control signal is changed from the low voltage level to the high voltage level when a data writing operation time elapses after the first control signal is changed from the high voltage level to the low voltage level.

18. An organic light emitting display device comprising:

a display panel including a plurality of pixel circuits configured to sequentially perform an on-bias operation, an initializing operation, a threshold voltage compensating operation, a data writing operation, and a light emitting operation; and a display panel driving circuit configured to provide a data signal, an initialization signal, a first control signal, a second control signal, a first power signal, and a second power signal to the pixel circuits, wherein the first control signal and the second control signal have the same voltage levels and the same edge times in a data writing period in which the data writing operation is performed, and wherein at least two voltage levels of the first control signal are different from at least two voltage levels of the second control signal in one or more operating periods other than the data writing period, or at least two edge times of the first control signal are different from at least two edge times of the second control signal in the one or more operating periods other than the data writing period.

19. The display device of claim 18, further comprising a data line configured to transmit a data signal, wherein each of the pixel circuits includes:

a first node;

a second node electrically connected to the data line;

a third node;

a first transistor including a gate terminal configured to receive the first control signal, a first terminal electrically connected to the first node, and a second terminal electrically connected to the second node;

a second transistor including a gate terminal configured to receive the second control signal, a first terminal electrically connected to the second node, and a second terminal electrically connected to the third node;

a third transistor including a gate terminal electrically connected to the first node, a first terminal configured to receive the first power signal, and a second terminal electrically connected to the third node;

a storage capacitor including a first terminal configured to receive the initialization signal and a second terminal electrically connected to the first node; and an organic light emitting diode including an anode electrically connected to the third node and a cathode configured to receive the second power signal, wherein the first control signal has a first high voltage level and a first low voltage level in the data writing period, wherein the first high voltage level is higher than the first low voltage level, wherein the first control signal has a second high voltage level and a second low voltage level in the one or more operating periods other than the data writing period, wherein the second high voltage level is lower than the first high voltage level, wherein the second low voltage level is higher than the first low voltage level, and wherein the second control signal has the first high voltage level and the first low voltage level.

20. The display device of claim 18, further comprising a data line configured to transmit a data signal, wherein each of the pixel circuits includes:

a first node;

a second node electrically connected to the data line;

a third node;

a first transistor including a gate terminal configured to receive the first control signal, a first terminal electrically connected to a first node, and a second terminal electrically connected to the second node;

a second transistor including a gate terminal configured to receive the second control signal, a first terminal electrically connected to the second node, and a second terminal electrically connected to the third node;

a third transistor including a gate terminal electrically connected to the first node, a first terminal configured to receive the first power signal, and a second terminal electrically connected to the third node;

a storage capacitor including a first terminal configured to receive the initialization signal and a second terminal electrically connected to the first node; and an organic light emitting diode including an anode electrically connected to the third node and a cathode configured to receive the second power signal, wherein the first control signal has a first rising edge time and a first falling edge time in the data writing period, wherein the first control signal has a second rising edge time and a second falling edge time in the one or more operating periods other than the data writing period, wherein the second rising edge time is longer than the first rising edge time, wherein the second falling edge time is longer than the first falling edge time, and wherein the second control signal has the first rising edge time and the first falling edge time.

* * * * *